US009757632B2

(12) United States Patent
Fryer et al.

(10) Patent No.: US 9,757,632 B2
(45) Date of Patent: Sep. 12, 2017

(54) DEVICE AND METHOD FOR LAUNCHING A PROJECTILE ACROSS A RANGE

(71) Applicant: SYMTAR VENTURES, Mt. Shasta, CA (US)

(72) Inventors: John Cornelius Fryer, Mt. Shasta, CA (US); Christopher Paul Zaler, Los Gatos, CA (US)

(73) Assignee: SYMTAR VENTURES, Mt. Shasta, CA (US)

( * ) Notice: Subject to any disclaimer, the term of this patent is extended or adjusted under 35 U.S.C. 154(b) by 0 days.

(21) Appl. No.: 14/886,309

(22) Filed: Oct. 19, 2015

(65) Prior Publication Data

US 2016/0375333 A1 Dec. 29, 2016

Related U.S. Application Data

(60) Provisional application No. 62/186,200, filed on Jun. 29, 2015.

(51) Int. Cl.

| | |
|---|---|
| ***A63B 59/02*** | (2006.01) |
| ***A63B 67/02*** | (2006.01) |
| ***A63B 65/12*** | (2006.01) |

(52) U.S. Cl.

CPC ..... *A63B 67/02* (2013.01); *A63B 65/122* (2013.01)

(58) Field of Classification Search

CPC ..... A63B 67/002; A63B 65/122; A63B 65/12; A63B 5/00; A63B 69/0002; A63B 69/36

See application file for complete search history.

(56) References Cited

U.S. PATENT DOCUMENTS

| | | | | | |
|---|---|---|---|---|---|
| 1,530,573 | A | * | 3/1925 | Olcott | A63B 59/20 124/5 |
| 1,585,446 | A | * | 5/1926 | Warwick | A63B 59/20 124/5 |
| 2,094,766 | A | * | 10/1937 | Costello | A63B 69/3632 473/138 |
| 3,428,036 | A | * | 2/1969 | Parker | A63B 59/20 124/41.1 |
| 3,989,247 | A | * | 11/1976 | Zimmerman | A63B 49/00 473/517 |
| 4,548,413 | A | * | 10/1985 | David | A63B 59/00 124/5 |
| 4,595,205 | A | * | 6/1986 | Ruperto | A63B 59/20 473/513 |

(Continued)

*Primary Examiner* — Melba Bumgarner
*Assistant Examiner* — Amir Klayman
(74) *Attorney, Agent, or Firm* — Jerry Haynes Law

(57) ABSTRACT

A device and method for launching a projectile, such as a golf ball, across a range. The device enables a golf ball to be launched across a golf course with greater control than is possible with a traditional golf club. The ease of loading the projectile into the launching device and swinging the launching device forward adds greater distance to the projectile due to an increase in angular momentum and back spin on the projectile. The device includes a C-shaped head defined by a nest, a pair of lateral retention arms, and a base. A distal portion is longer than a proximal portion to create backspin on the projectile. The concavity and lateral arms hold the projectile in place. The distal and proximal portions terminate at concave points that grip dimples on the projectile. The base is fixedly attached to a shaft, which is used for swinging the head.

16 Claims, 5 Drawing Sheets

(56) References Cited

U.S. PATENT DOCUMENTS

| | | | | |
|---|---|---|---|---|
| D424,640 | S | 5/2000 | Oblack | |
| 6,076,829 | A | 6/2000 | Oblack | |
| D554,717 | S | 11/2007 | McKinnell | |
| 7,686,001 | B2 | 3/2010 | Fitt | |
| D630,277 | S | 1/2011 | McKinnell | |
| D637,248 | S | 5/2011 | Levin et al. | |
| D640,338 | S | 6/2011 | Oblack et al. | |
| 8,015,968 | B2 * | 9/2011 | Christ | A63B 65/00 124/5 |
| D655,359 | S | 3/2012 | Thorogood | |
| D666,686 | S | 9/2012 | Burger | |
| D674,851 | S | 1/2013 | Osborne et al. | |
| 8,960,172 | B2 * | 2/2015 | Ivanic | A63B 59/02 124/5 |
| 2002/0028712 | A1 | 3/2002 | Williamson | |
| 2009/0203458 | A1 * | 8/2009 | Presley | A63B 63/00 473/157 |
| 2014/0144417 | A1 * | 5/2014 | Evans | A63B 65/122 124/5 |
| 2015/0007803 | A1 | 1/2015 | Van Alan et al. | |
| 2015/0013653 | A1 | 1/2015 | Clarke et al. | |
| 2015/0018129 | A1 | 1/2015 | Van Alan et al. | |
| 2015/0090237 | A1 * | 4/2015 | Williams | F41B 3/03 124/16 |

* cited by examiner

DEVICE AND METHOD FOR LAUNCHING A PROJECTILE ACROSS A RANGE

CROSS REFERENCE OF RELATED APPLICATIONS

This application claims the benefits of U.S. provisional application No. 62/186,200, filed Jun. 29, 2015 and entitled LAUNCHING DEVICE AND METHOD FOR FACILITATING LONG SHOTS OF A GOLF BALL ACROSS A GOLF COURSE, which provisional application is incorporated by reference herein in its entirety.

FIELD OF THE INVENTION

The present invention relates generally to a device and method for launching a projectile over a distance. More so, the present invention relates to a device and method that facilitates launching a projectile, such as a golf ball, accurately and over a distance across a range by retaining the projectile in a generally C-shaped head comprising of a concave nest having asymmetrical lengths that engage a projectile, and impart angular velocity and torque on the projectile when the device is swung in a forward direction with a shaft, such that the consequential spin on the projectile is consistent.

BACKGROUND OF THE INVENTION

The invention teaches a device and method that launches a projectile, such as a golf ball, across a range with greater control than a traditional golf club and greater distance than a human throwing a projectile unassisted.

Typically, the sport of golf is played with a generally spherical ball having dimples that enhance the aerodynamics of the ball in flight, a club for striking the golf ball, and a golf course, on which the golf ball is manipulated. The sport requires players to use various clubs to hit balls into a series of holes on the golf course in as few strokes as possible. The golf course has an arranged progression of eighteen holes. Each hole on the golf course has at a minimum a tee box or teeing ground to start from and a putting green containing the actual hole. Striking the golf ball from the tee box or teeing ground generally requires a longer distance. This is necessary, so as to position the ball proximally to the target. The device does not necessarily have to be used on a golf course. The device can also be used on the fairway or in any condition (rough, trees, etc.) to aid in throwing the golf ball toward or at the green.

It is known that a golf course consists of a series of holes, each with a teeing ground that is set off by two markers showing the bounds of the legal tee area, fairway, rough and other hazards, and the putting green surrounded by the fringe with the flag stick and cup. Every round of golf is based on playing a number of holes in a given order. Playing a hole on a golf course is initiated by striking a ball into play by striking the golf ball with a club on the teeing ground.

Generally, golf clubs are used to hit the golf ball. Each club is composed of a shaft with a grip or handle on the proximal end and a club head on the distal end. Long clubs, which have a lower amount of degreed loft, are those meant to propel the ball a comparatively longer distance. In many instances, for this first shot on each hole, it is allowed but not required for the golfer to place the ball on a tee prior to striking the golf ball.

Those skilled in the art recognize that hitting the golf ball with the longer club over a long distance, and with accuracy, requires skill and many hours of practice. This practice time to develop a long and accurate tee shot is not always possible—especially for novices, children, and players who have limited time to allocate to golf.

Other proposals have involved sporting equipment to strike and launch golf balls from the tee. The problem with these sporting equipment configurations is that they require great skill and practice to master in order to strike the golf ball with accuracy and distance. Even though the above cited golf clubs and general golf ball striking equipment meet some of the needs of the market, a device and method that launches a golf ball across a range with greater control than is possible with a traditional golf club is still desired.

SUMMARY OF THE INVENTION

Illustrative embodiments of the disclosure are generally directed to a device and method that facilitates launching a projectile over a distance across a range. The device and method is configured to launch a projectile, such as a golf ball, across a range. The device enables a golf ball to be launched across a golf course with greater control and with a shorter learning curve than is possible with a traditional golf club. The ease of loading the golf ball into the launching device and swinging the launching device in a forward direction adds greater control and accuracy to the golf ball due to an increase in angular momentum and torque that are transmitted from the device to the golf ball.

In one embodiment, the device includes a C-shaped head defined by a nest, a pair of lateral retention arms, and a base. A distal portion is longer than a proximal portion to create spin. The lateral arms hold the ball in place. Though, the lateral arms do not necessarily have a function. The concave nest creates greater surface area for the projectile which imparts spin on the projectile. The base of the C-shaped head remains stationary while releasably attaching to a shaft. Though, in one alternative embodiment, the base of the C-shaped head pivots. The shaft is operable to swing the C-shaped head in a direction for launching the projectile.

It is significant to note that the design intent of the more distal section of the nest to the ball is the riding surface of the projectile and the creator of spin. There is clearance within the nest that, when combined with momentum, causes the projectile to only ride on the more distal section. The more proximal section of the nest is shorter for ease of installation of the projectile, mold-ability, reducing surface area/drag and to promote more friction to the more distal section. This is especially true in the case where the technique used to throw the projectile isn't optimal.

The projectile may include a golf ball having a generally spherical shape and a plurality of dimples uniformly spaced across the surface of the golf ball. Though, in other embodiments, the projectile may include, without limitation, a ball, scuttle cock, a cone, a rock, a missile, and ammunition. The range across which the projectile is launched may include a golf course that initiates at a tee shot. Thus, in one possible embodiment, the device and method may be efficacious in enabling a golf ball to be launched across a golf course with greater control than is possible with a traditional swing with a golf club.

One aspect of a device for facilitating shots of a golf ball across a golf course, comprises:

a generally C-shaped head, the generally C-shaped head defined by a nest, a pair of lateral retention arms, and a base, the nest having a distal portion and a proximal portion, the distal portion terminating at a distal concave point, the proximal portion terminating at a proximal concave point, the pair of lateral retention arms disposed laterally relative to the nest, the base having an opening; and a shaft, the shaft defined a head end and a handle end, the shaft configured impart torque on the nest when swinging in a forward direction, the opening of the base configured to detachably mate with the shaft.

In another aspect, the generally C-shaped head is configured to releasably retain a projectile.

In another aspect, the projectile is a generally spherical golf ball having a plurality of dimples.

In another aspect, the pair of lateral retention arms are configured to form an arc away from the nest, the arc being sized and dimensioned to retain the golf ball in the nest.

In another aspect, the pair of lateral retention arms are configured to form an arc away from the nest, the arc being sized and dimensioned to retain the golf ball on the nest.

In another aspect, the longer dimensions of the distal portion relative to the proximal portion enable creation of spin on the golf ball while launching the golf ball.

In another aspect, the distal concave point and proximal concave point are configured to grip the plurality of dimples of the golf ball.

In another aspect, the distance between the distal portion and the proximal portion of the head is about 1.69 inches.

In another aspect, the head is fabricated from aluminum or a polymer.

In another aspect, the shaft is generally elongated and somewhat flexible.

In another aspect, the shaft is about 2' long±4".

Yet another aspect of a method for launching a golf ball with a device to facilitate long shots of a golf ball across a golf course, comprises:

providing a golf course, the golf course comprising at least a golf tee, a fairway, a golf green, and a hole;

providing a device, the device configured to launch a golf ball from the golf tee and across the fairway, the device comprising a nest, a pair of lateral retention arms, a base, and a shaft, the nest having a distal portion and a proximal portion, the distal portion configured to be longer than the proximal portion, the distal portion terminating at a distal concave point, the proximal portion terminating at a proximal concave point;

placing the golf ball in a secure positon between the nest and the pair of lateral retention arms;

engaging the distal concave point and the proximal concave point with dimples in the golf ball;

grasping the shaft in a rearward position;

swinging the shaft in an overhead or sideways or underhand forward direction towards the hole in the golf course;

imparting torque on the head; and disengaging the golf ball from the head with back spin.

In some embodiments, the device may be defined by a generally C-shaped head that is configured to retain, control, and release the projectile. The C-shaped head is defined by a nest, a pair of lateral retention arms, and a base.

The nest provides a substantial amount of the surface area that engages the projectile. The nest includes a distal portion and a proximal portion, whereby the distal portion is generally longer than the proximal portion. In one embodiment, the distal portion is longer, and thus covers more surface area on the projectile. This is significant because when the head is swung in a forward direction, the longer distal portion of the nest has more surface area and remains engaged with the projectile for a slightly longer duration than the shorter proximal portion. This variance in contact time serves to impart a spin, i.e., rotation, on the golf ball as it disengages from the head, and especially when the head is swung in an overhead or sideways forward direction.

The distal portion of the nest terminates at a distal concave point. The proximal portion of the nest terminates at a proximal concave point. In one possible embodiment, the distal and proximal concave points are configured to engage a plurality of dimples that form on the outer surface of the projectile. This gripping engagement enables the C-shaped head to provide greater spin and torque when launching the projectile. The dimpled projectile, as used in this embodiment, may include a generally spherical golf ball having uniformly spaced dimples. The pair of lateral retention arms are disposed laterally relative to the nest.

In some embodiments, the base may include an opening. The base is configured to remain fixed in relation to the nest. The device may further include a shaft that is configured to attach to the C-shaped head by detachably coupling into the opening in the base of the C-shaped head. The shaft helps control the C-shaped head for launching the projectile.

The shaft is elongated and provides a secure surface of a user to grip and manipulate, as needed to launch the projectile. Specifically, the shaft imparts torque and angular velocity on the C-shaped head while being swung in a forward direction. The consequential backspin is transmitted to the projectile, thereby launching the projectile in a more controllable manner and for a longer distance when thrown generally overhand.

The shaft is defined a head end and a handle end. The head end is configured to detachably mate with the opening of the base. The design of the head end is one piece. The head end can disengage from the shaft by a pin. Though in some embodiments, the head end can be separated into two pieces for removal of and switching out the shaft and also to control the ball release angle. The base and nest may be held on by an axle where the nest could be adjusted by rotation to change the ball release angle which in turn would change the trajectory of the ball flight. This capacity to disassemble enables the device to impart different functioning shafts, be stored and carried more efficiently.

Thus, in one embodiment, the nest remains fixed against the base in a first direction to press against the head end of the shaft, and thereby lock the shaft into the base. Conversely, the nest remains fixed against the base in a second direction to disengage the head end from the shaft, and thereby release the shaft from the base.

In one exemplary method of use, the device is operable by releasably retaining the projectile in a generally C-shaped head. The C-shaped head comprises two concave contact points that engage in unsymmetrical contact across a dimpled surface area of the projectile. For example, when the ball is loaded in the nest, it contacts the c-shape approximately 180 degrees. When the ball is being released the surface becomes two contact points.

The C-shaped head imparts torque and angular velocity on the projectile when the head is swung in a forward direction, such that the consequential back spin on the projectile is controllable. In this manner, the device negates the need to use a tool, such as a golf club for launching the projectile.

One objective of the present invention is to provide a device that efficiently imparts torque, angular velocity on a golf ball, so as to increase the range and accuracy for launching the golf ball.

Another objective is to provide a device that helps inexperienced and physically limited golfers to launch a golf ball over a long distance over a golf course with accuracy and efficiency.

Another objective is to provide a device that replaces the golf club for striking a golf ball across a golf course.

Another objective is to provide a device that launches the golf ball with an overhead or sideways forward swinging motion.

Yet another objective is to impart more consistent spin and angular velocity on the golf ball than is possible with a golf club.

Yet another objective is to change the concave surface material on the distal portion of the nest to impart greater change to the spin of the ball.

Yet another objective is to have a rotational distal nest portion where different materials could be switched out by a quick rotation.

Yet another objective is to provide a concave surface on the termini of the head, so as to enhance the grip on the golf ball until sufficient angular velocity has been reached to launch the golf ball.

Yet another objective is to provide an inexpensive device that can replace multiple tee shot and iron golf clubs.

BRIEF DESCRIPTION OF THE DRAWINGS

The invention will now be described, by way of example, with reference to the accompanying drawings, in which:

FIG. 2A illustrates an exemplary C-shaped head oriented proximally, and FIG. 2B illustrates the C-shaped head oriented distally, in accordance with an embodiment of the present invention;

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

Figure 1:
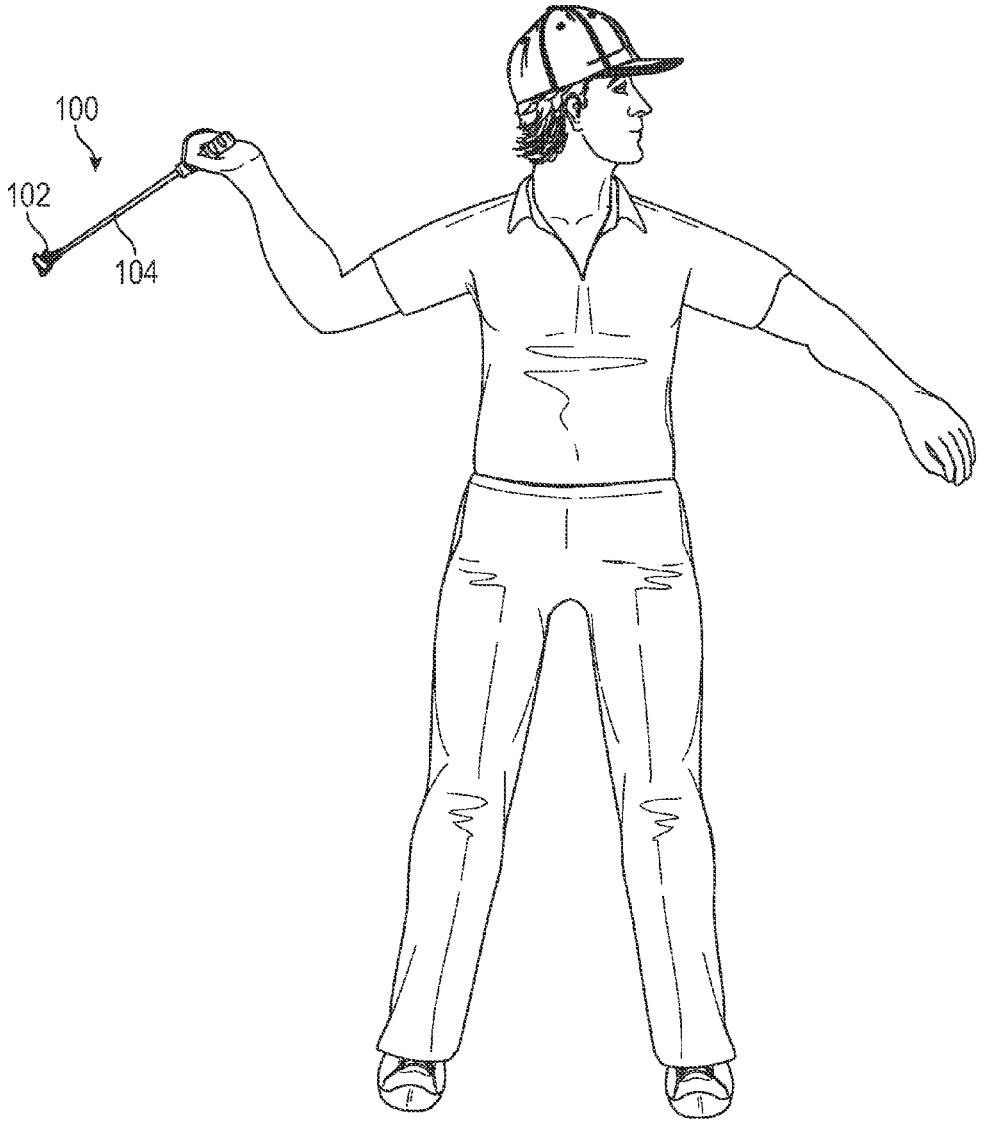
FIG. 1 illustrates a perspective view of an exemplary method for launching a golf ball with an exemplary launching device, in accordance with an embodiment of the present invention.

A device 100 and method 200 for launching a projectile across a range is referenced in FIGS. 1-5. As illustrated in FIG. 1, the device 100 and method 200 creates a more efficient and controlled launch of a projectile over an extended length of a range. Also, the elevation of the projectile and backspin applied on the projectile are more effectively controlled through use of the device 100 and method 200.

In one embodiment, the projectile may include a golf ball having a generally spherical shape and a plurality of dimples uniformly spaced across the surface of the golf ball. Though, in other embodiments, the projectile may include, without limitation, a ball, a cone, a rock, a missile, a light, and ammunition. The range may include a golf course that initiates at a tee. Though in other embodiments, the range may include, without limitation, a field, a sports field, an indoor arena, a gym, and a battlefield.

Thus, in one exemplary embodiment, the device 100 and method 200 may be efficacious in enabling a golf ball to be launched across a golf course with greater control than is possible with a traditional swing with a golf club. The device 100 and method 200 also enables a novice golf player to launch the golf ball more accurately towards the target.

This enhanced launching of the golf ball is possible because of a unique C-shaped head 102 that is configured to grip the dimples that form on the outer surface of the golf ball, and then impart torque and angular velocity on the golf ball while the golf ball is being launched. The device further includes a unique shaft 104 that detachably attaches to the C-shaped head 102. The shaft 104 is configured to enable easy control and performance of the C-shaped head 102. The combination of the C-shaped head 102 and the shaft 104 allows for a more controlled backspin on the golf ball, thereby increased accuracy towards the target hole.

The ease of loading the projectile into the C-shaped head 102 and swinging the shaft 104 forward to launch the projectile adds greater distance to the flight of the projectile due to the unique design of the C-shaped head 102 that increases the torque, angular momentum, and consequentially, the backspin on the projectile. The head 102 includes a ball plunger 126 (FIG. 3) that is disposed concentrically in the nest to help retain the projectile in the nest 106 from a natural release position.

Those skilled in the art will recognize that swinging a golf club effectively, and especially for accurate placement of the golf ball on tee shots and other difficult areas of the golf course, requires myriad hours of training and instruction. It is significant to note that the device 100 does not necessarily have to be used on a golf course. The device can also be used on the fairway or in any condition (rough, trees, etc.) to aid in throwing the golf ball toward or at the green.

Many players do not have the time or resources to spend on such a luxury. Also, performing the golf club swing exerts large amounts of torque on the torso, spine, and knees of a player. Many players have health problems or are too elderly to generate enough power in their lower body for an accurate, strong swing. It is known that by facilitating the long shot on a golf course, larger numbers of players will play golf Consequently, this lower physical entry point increases interest in golf, and increases revenue for golf courses.

Thus, the device 100 and method provide novel features that create a substantially different type of golf game, whereby a golf club is not necessary for longer shots across a fairway. In this manner, inexperienced players, disabled players, and physically challenged players do not have to swing a golf club to advance a golf ball across the longer distances of the golf course, such as the fairway, sand traps, or rough. Further, different sports, and even battle field strategies may be altered through use of the device 100 and method 200.

Figure 2A:
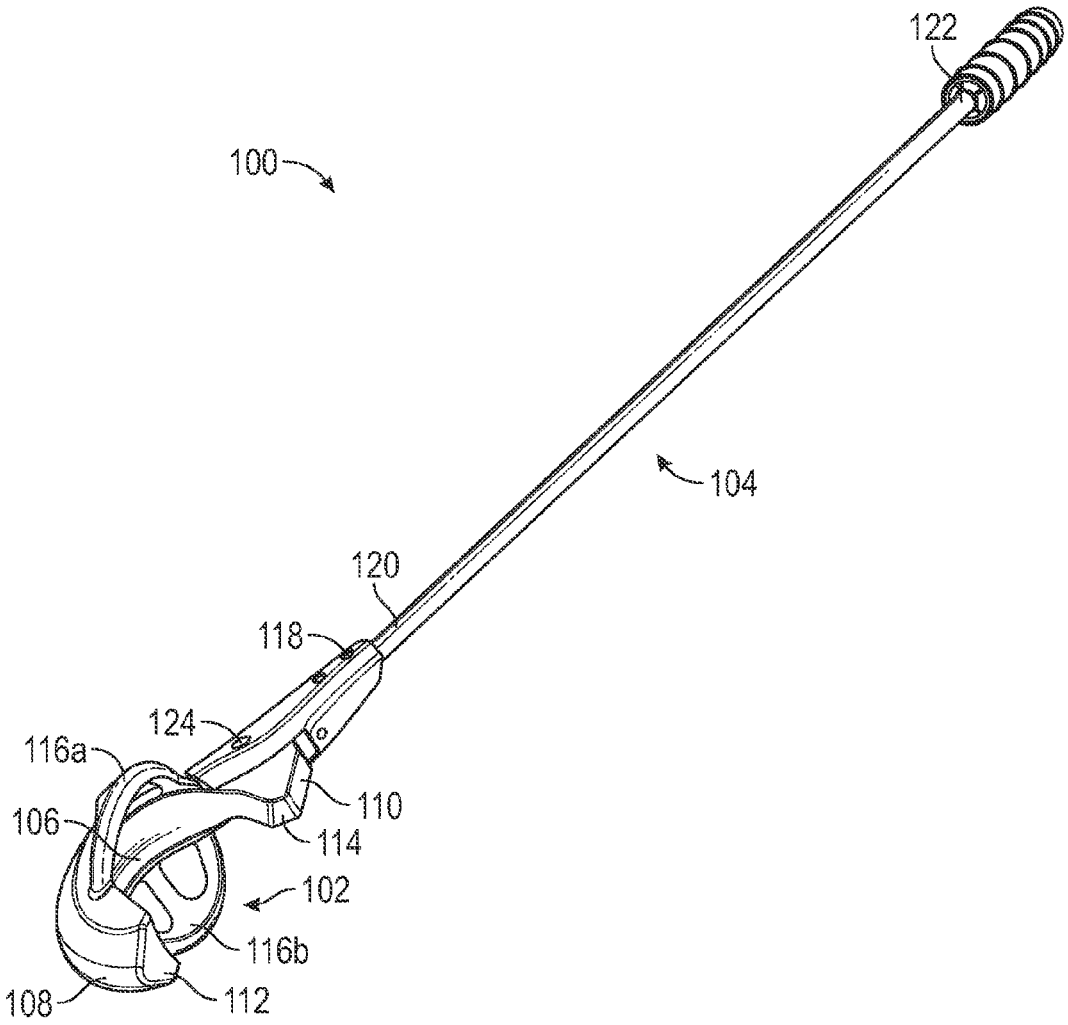
FIGS. 2A and 2B illustrate perspective views of an exemplary launching device, where
Figure 2B:
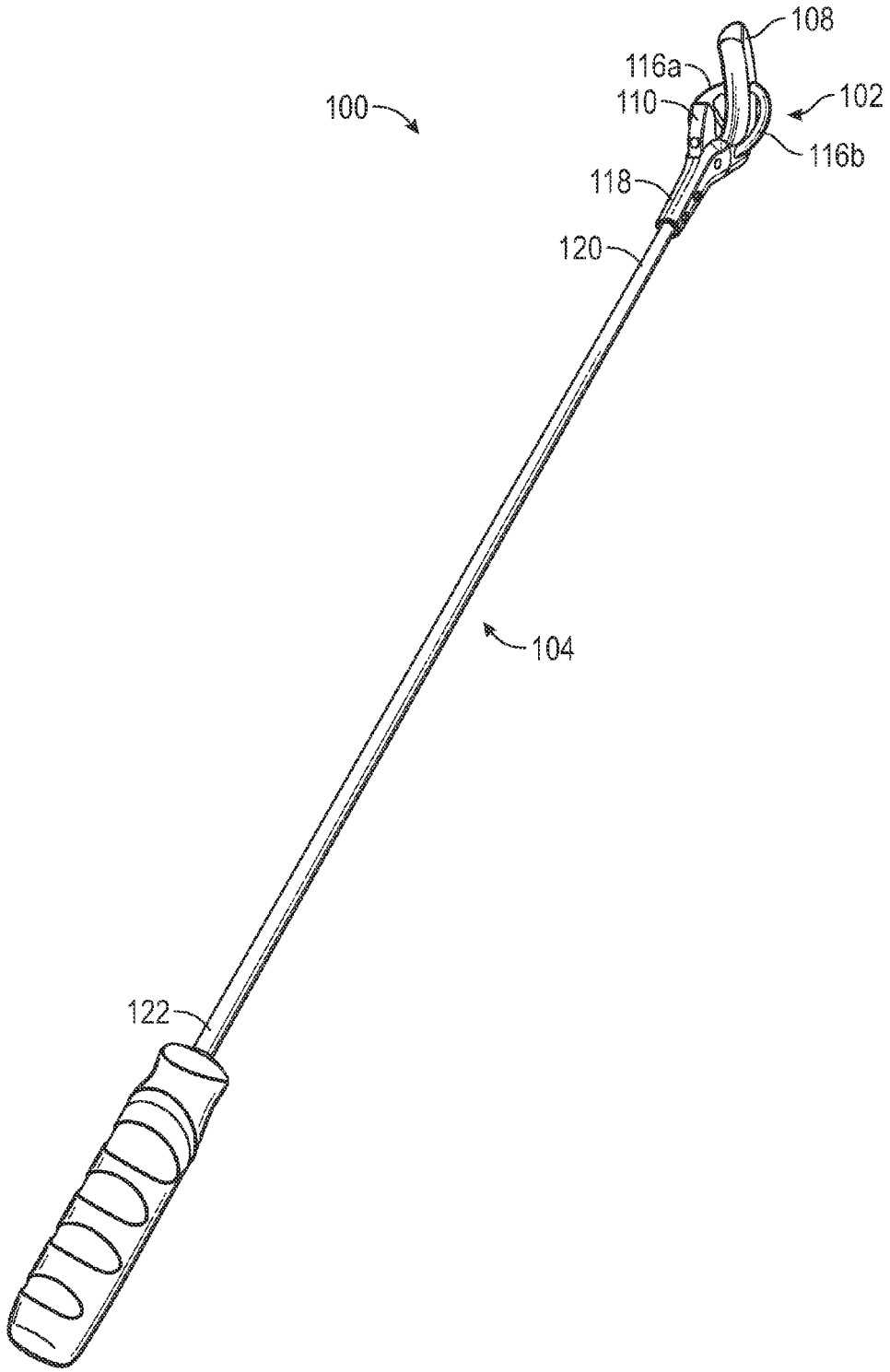

Looking now at FIGS. 2A and 2B, the device 100 is configured to facilitate long shots of a projectile across a range by releasably retaining the projectile in a generally C-shaped head 102. The generally C-shaped head 102 is defined by a nest 106, a pair of lateral retention arms 116*a-b*, and a base 118. The nest 106 forms a half-hemisphere that is sized and dimensioned to releasably retain the projectile, such that a surface area region of the projectile is engaged by the nest 106 prior to launching.

Figure 3:
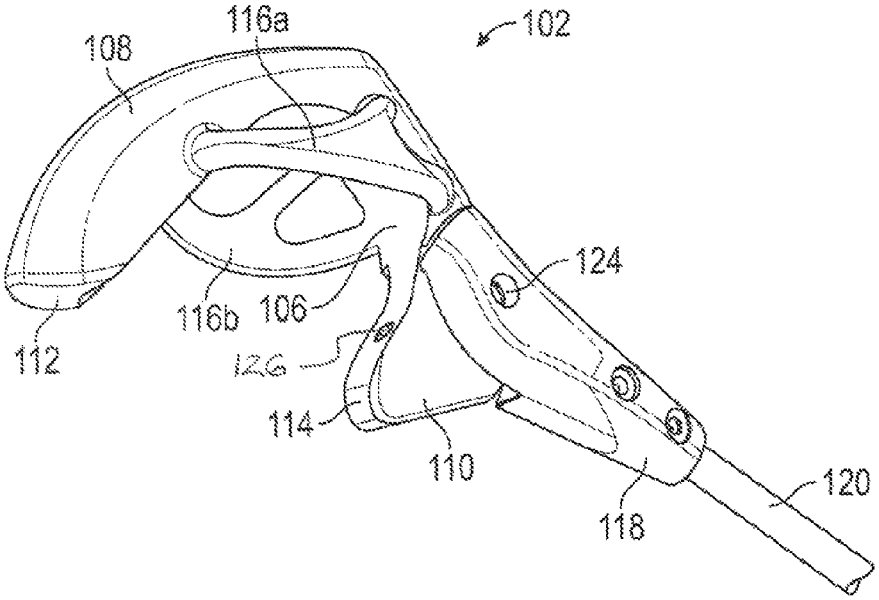
FIG. 3 illustrates a side perspective view of the C-shaped head, in accordance with an embodiment of the present invention.

In one embodiment, the nest 106 is configured to retain and launch a generally spherical-shaped golf ball having a plurality of uniformly spaced dimples. In one embodiment, a ball plunger 126 is disposed concentrically in the nest to help retain the projectile in the nest 106 from a natural release position. The ball plunger 126 is shown in FIG. 3 on the concave surface of the proximal nest section. It holds the ball wonderfully during the back swing and releases the ball effortlessly without losing yardage.

Turning now to FIG. 3, the nest 106 includes a distal portion 108 that terminates at a distal concave point 112. The nest 106 further includes a proximal portion 110 that terminates at a proximal concave point 114. The distance between the distal portion 108 and the proximal portion 110 of the C-shaped head 102 may be about 1.69". Though other dimensions may be used, depending on the type of projectile. In on embodiment, the surface area of the distal portion 108 and friction of that surface area to the golf ball creates backspin Those skilled in the art will recognize that the diameter of a golf ball is about 1.68". Thus, a projectile may rest in a generally snug engagement within the nest 106, so as not to disengage from the nest 106 until sufficient angular momentum has been generated to forcibly launch the projectile from the nest 106 of the C-shaped head 102.

As shown in FIG. 3, the length and surface area of the distal portion 108 and the proximal portion 110 is unequal. This unequal length and surface is efficacious for generating backspin on the projectile, especially a spherical projectile. The different length of the distal portion 108 and the proximal portion 110 creates unsymmetrical contact across the surface area of the projectile.

In one embodiment, the distal portion 108 is longer and wider, and thus covers more surface area on the projectile. This is significant because when the head 102 is swung in a forward direction, the longer distal portion 108 of the nest 106 remains engaged with the projectile for a slightly longer duration than the shorter proximal portion 110. For example, this variance in contact time and surface area serves to impart a back spin, i.e., rotation, on a golf ball as it disengages from the head 102, and especially when the head 102 is swung in an overhead or sideways forward direction.

Further, the twisting swinging motion produced while launching the projectile produces torque on the C-shaped head 102. This torque changes the angular velocity of the C-shaped head 102, causing back spin on the projectile, especially a spherical projectile such as a golf ball. For example, the back spin creates turbulence, such as a magnus effect, in the layer of air next to the golf ball. The magnus effect is efficacious for increasing the distance of travel by the golf ball across the golf course. The magnus effect creates lift when the head 102 is swung in the overhead position. This is because the turbulent air flow is not likely to separate from the golf ball, and thus create drag.

It is significant to note that the dimples on a golf ball create turbulence in the layer of air next to the golf ball during travel. Thus, the combination of the back spin and the dimples on the golf ball produce sufficient turbulence to minimize drag on the golf and produce a more directionally consistent spin when compared to a traditional swing with a golf club. Also, by increasing or decreasing the back spin of the golf ball, greater control of the golf ball is possible when it initially lands on the golf course, i.e., spin left, spin right, spin back.

Looking back at FIG. 2A, the distal concave point 106 and the proximal concave point 114 form termini on the distal portion 108 and the proximal portion 110. In one embodiment in which the device 100 is used to launch a golf ball, the distal concave point 112 has a generally concave contour that is configured to increase surface area on the golf ball which in turn increases friction with the ball. This engagement increases grip on the golf ball, which further enhances control of the golf ball and the ball plunger 126 inhibits premature disengagement between the golf ball and the C-shaped head 102. Even when the projectile does not have dimples, however, the torque, angular velocity, and consequential backspin is still applicable due to the unique configuration of the distal and proximal concave points 112, 114.

The pair of lateral retention arms 116*a-b* are disposed to extend laterally from the nest 106. The lateral retention arms 116*a-b* may arc out and away from the nest 106 to fit the shape of the projectile. This creates a secure fit for the projectile from five directions: Up, down, left side, right side and backward. The lateral retention arms 116*a-b* help prevent the projectile from premature disengagement from the nest 106, such as when carrying the projectile or pulling back for a swing, prior to launching the C-shaped head 102 forward. The lateral retention arms 116*a-b* also enhance directional control of the projectile. In one embodiment, the lateral retention arms 116*a-b* form a webbed configuration.

Figure 4:
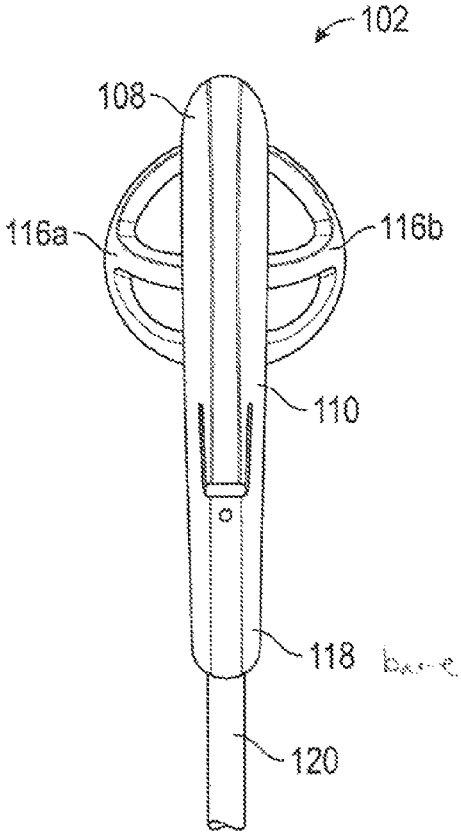
FIG. 4 illustrates a backside view of the C-shaped head, in accordance with an embodiment of the present invention.

FIG. 4 illustrates an embodiment in which the C-shaped head 102 fixedly fastens, and detachably release the shaft 104. This detachable attachment enables the device 100 to provide interchangeability with variously sized and stiffness shafts. Though, in one alternative embodiment, the base of the C-shaped head 102 pivots against the shaft 104

The base 118 is disposed adjacent to the nest 106. The base 118 fixedly joins the nest 106 and the pair of lateral retention arms 116*a-b*. In future embodiments, an axle 124 may pass through a pin hole between the base 118 and the nest 106 to enable fastening there between (FIG. 3). This allow adjustment for different ball release angles. The base 118 has an opening to receive a shaft 104 that detachably attaches to the head 102 through the base 118. The opening in the base 118 allows the shaft 104 to be interchangeable.

The base 118 has an opening to receive the head end 120 of the shaft 104. The shaft 104 is generally elongated, flexible, and defined by a shaft 104 end and a handle end 122. The base 118 forms a detachable attachment between the shaft 104 and the C-shaped head 102. In one embodiment, the C-shaped head 102 remains fixed against the base 118 in a first direction to press against the head end 120 of the shaft 104, and thereby lock the shaft 104 into place. The C-shaped head 102 fixedly joins the base 118 in a second direction to disengage from the head end 120 of the shaft 104, and thereby release the shaft 104 from the C-shaped head 102. It is significant to note that, in future iterations the main intent would be to change the release angle of the ball creating different flight patterns. Or to interchange different frictional surface on the distal nest to produce different spin.

In other embodiments, however, the detachable attachment that forms between the C-shaped head 102 and the shaft 104 may utilize other fastening mechanisms, including, without limitation, a snap-lock connection, a spring-biased button, a magnet, a threaded terminus, an adhesive, and a frictional force. Further, in an alternative embodiment, the shaft 104 may hinge at a central region to compact for facilitated stowage and portability.

As illustrated in FIG. 2A, the elongated and generally flexible configuration of the shaft 104 provides control for launching the projectile. The shaft 104 has sufficient flexibility, such that a whipping motion is produced to increase velocity. Also, the length of the shaft 104 enables it to be swung forward in an overhead, sideways, or an underhand forward direction, so as to create centrifugal force that imparts angular velocity on the C-shaped head 102. This angular velocity creates torque on the projectile that causes the projectile to be released from the C-shaped head 102 with backspin, resulting in greater distance and accuracy.

In some embodiments, various lengths of shafts 104 can be interchanged onto the C-shaped head 102. In this manner, an appropriate shaft length can be selected for each player or golf course circumstances. The flexibility provided by changing the length of the shaft 104 provides greater control of the direction and distance for launching the projectile. In one embodiment, the handle end 122 of the shaft 104 may include a rubber grip to enhance control of the shaft 104 wile swinging the C-shaped head 102 in the overhead or sideways forward direction.

In one possible embodiment, the shaft 104 may be fabricated from various materials known in the sport of golf, including, without limitation, carbon fiber, graphite, aluminum, titanium, metal alloys, polymers, or wood. The shaft 104 may also be about 2' long and have a generally cylindrical shape. Though other dimensions for the shaft 104 may be used.

Figure 5:
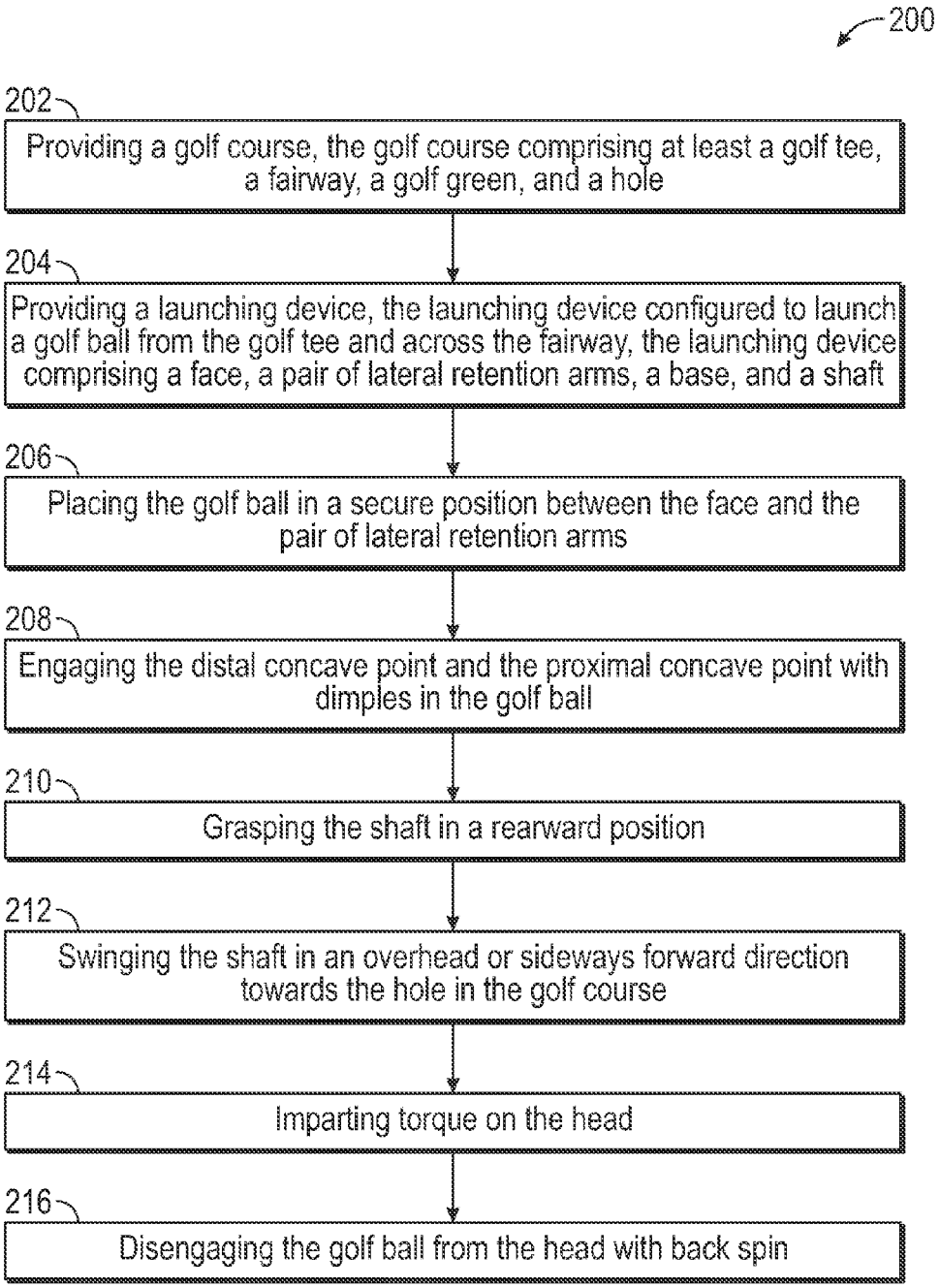
FIG. 5 illustrates a flowchart diagram of an exemplary method for launching a golf ball with a device to facilitate long shots of a golf ball across a golf course, in accordance with an embodiment of the present invention.

As shown in the flowchart of FIG. 5, a method 200 for launching a golf ball with a device 100 to facilitate throwing a golf ball across a golf course, comprises an initial Step 202 of providing a golf course. The golf course may include at least a teeing ground, a golf green, and a hole. The goal is to initially hit the golf ball across the longer fairway, and then putt the golf ball into the hole at the shorter, contoured greens. The device 100 is utilized in the longer teeing portion of the golf course. Generally, the device 100 is used for long shots on the tee and in the fairway. Though in some embodiments, the device 100 can also be used for shorter shots.

The method 200 may further comprise a Step 204 of providing a device 100, the device 100 configured to launch a golf ball from the tee box, across the fairway and to the green, the device 100 comprising a C-shaped head 102, a nest 106, a pair of lateral retention arms 116*a-b*, a base 118, and a shaft 104, the nest 106 having a distal portion 108 and a proximal portion 110, the distal portion 108 configured to be longer than the proximal portion 110, the distal portion 108 terminating at a distal concave point 112, the proximal portion 110 terminating at a proximal concave point 114.

The ease of loading the golf ball into the device 100 and swinging the device 100 forward adds greater distance to the golf ball when throwing unaided. This is due to an increase in centrifugal force, inertia, and back spin on the golf ball imparted by body mechanics. The device 100 includes a generally C-shaped head 102 defined by a nest 106, a pair of lateral retention arms 116*a-b*, and a base 118. The nest 106 includes a distal portion 108 and a proximal portion 110. The distal portion 108 is longer than the proximal portion 110, so as to create backspin on the golf ball.

A Step 206 includes placing the golf ball in a secure positon between the nest 106 and the pair of lateral retention arms 116*a-b* so the golf ball is encompassed within the nest 106. The generally arced configuration of the lateral retention arms 116*a-b* and the nest 106 are sized and dimensioned to secure the golf ball in place for the natural release position. However, from the natural release position, the ball plunger 126 retains the ball. The base 118 releases and locks a shaft 104 used for swinging the C-shaped head 102. In some embodiments, a non-spherical projectile may also be used in place of the golf ball, with the nest 106 and pair of lateral retention arms 116*a-b* configured to retain the non-spherical projectile in substantially the same manner.

In some embodiments, a Step 208 comprises engaging the golf ball with a ball plunger 126 to retain the golf ball while in the natural release position. The distal and proximal portions 108, 110 terminate at concave points that grip dimples on the golf ball for enhancing grip until the golf ball is launched. Each concave point 112, 114 engages the golf ball from an opposite direction, so as to further enhance the grip. The enhanced grip on the golf ball enables contact between the nest 106 and the golf ball until sufficient angular velocity has been reached to launch the golf ball.

A Step 210 includes grasping the shaft 104 proximally. The shaft 104 is connected to the C-shaped head 102 through the base 118. The shaft 104 is brought back behind a user and then swung forward to impart torque on the C-shaped head 102. This is easier to perform than the traditional swing of the golf club. The forward swing increases the angular velocity on the C-shaped head 102 when launching the golf ball. In one embodiment, the length or flexibility of the shaft 104 may be changed to increase or decrease the angular velocity and back spin on the golf ball. Also, the flexible nature of the shaft 104 creates a whiplash effect that increases velocity.

This interchangeability is possible because the base 118 has an opening to receive the head end 120 of the shaft 104. The base 118 detachably attaches to the shaft 104 and the C-shaped head 102. In one embodiment, the C-shaped head 102 remains fixed against the base 118 in a first direction to press against the head end 120 of the shaft 104, and thereby lock the shaft 104 into place. The C-shaped head 102 remains fixed against the base 118 in a second direction to disengage from the head end 120 of the shaft 104, and thereby release the shaft 104 from the C-shaped head 102.

In some embodiments, a Step 212 may include swinging the shaft 104 in a forward direction towards a target. The shaft 104 has sufficient length to impart centrifugal force on the C-shaped head 102 when swung in an overhead or sideways forward direction. This force causes the golf ball to be launched from the C-shaped head 102 with greater speed and accuracy.

A Step 214 comprises imparting torque on the C-shaped head 102. The twisting swinging motion produced while launching the golf ball produces torque on the C-shaped head 102. This torque changes the angular velocity of the C-shaped head 102, causing back spin on the golf ball. The back spin creates turbulence in the layer of air next to the golf ball. The turbulence is efficacious for increasing the distance of travel by the golf ball across the golf course.

A final Step 216 includes disengaging the golf ball from the C-shaped head 102 with back spin when thrown overhead. For most inexperienced or physically limited players, the golf ball launches from the device 100, traveling across the golf course, and specifically the fairway, with greater accuracy than could normally be achieved with a traditional swing with a golf club. In one possible embodiment, the golf ball may travel upwards of 180 yards or more when launched from the device 100. Those skilled in the art will recognize the novice golf players may especially benefit from the added target accuracy afforded by the device 100.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A device for launching a projectile across a range, the device comprising:

a generally C-shaped head, the generally C-shaped head defined by a nest, the nest forms a half-hemisphere sized and dimensioned to releasably retain the projectile, a pair of lateral retention arms, and a base, the nest having a distal portion and a proximal portion, a distance between the distal portion and the proximal portion of the C-shaped head corresponding generally to a diameter or width of the projectile, the distal portion terminating at a distal concave point, the proximal portion terminating at a proximal concave point, the distal portion greater in length, width and surface area than the proximal portion, the pair of lateral retention arms extending outwardly from the nest in opposite directions to each other and disposed laterally relative to the nest, the base having an opening, each of the lateral retention arms having a proximal end attached to the nest proximate the proximal portion and a distal end attached to the nest proximate the distal portion of the nest, wherein the pair of lateral retention arms form an arc away from the nest, the arc being sized and dimensioned to retain the projectile on the nest; and a shaft, the shaft defined by a head end and a handle end, the opening of the base configured to detachably mate with the shaft.

2. The device of claim 1, wherein the generally C-shaped head is configured to retain and launch a generally spherical projectile.

3. The device of claim 2, wherein the generally spherical projectile is a golf ball having a spherical shape and a plurality of dimples.

4. The device of claim 3, wherein the surface area of the distal portion relative to the proximal portion enables creation of backspin on the golf ball while launching the golf ball.

5. The device of claim 4, wherein the distal concave point and proximal concave point are configured to grip the plurality of dimples of the golf ball.

6. The device of claim 1, further including a ball plunger, the ball plunger disposed concentrically in the nest to retain the golf ball.

7. The device of claim 1, wherein the distance between the distal portion and the proximal portion of the C-shaped head is about 1.69 inches.

8. The device of claim 1, wherein the material composition of the C-shaped head includes at least one member selected from the group consisting of: aluminum, metal alloys, wood, fiberglass, bamboo, and a rigid polymer.

9. The device of claim 1, wherein the shaft is generally elongated and flexible.

10. The device of claim 1, wherein the shaft is about 2 feet long and is configured to retain and launch a generally non-spherical projectile.

11. The device of claim 10, wherein the non-spherical projectile includes at least one member selected from the group consisting of: a cone, a shuttle cock, a rock, a missile, and ammunition.

12. A launching device, the device comprising:

a golf ball, the golf ball defined by a generally spherical shape and a plurality of dimples, the golf ball configured to be retained and launched by the device;

a generally C-shaped head, the generally C-shaped head defined by a nest, the nest forms a half-hemisphere sized and dimensioned to releasably retain the projectile, a pair of lateral retention arms, and a base, the nest having a distal portion and a proximal portion, a distance between the distal portion and the proximal portion of the C-shaped head corresponding generally to a diameter or width of the golf ball, the distal portion having longer and wider surfaces and having greater surface area than the proximal portion, each of the lateral retention arms having a proximal end attached to the nest proximate the proximal portion and a distal end attached to the nest proximate the distal portion of the nest;

wherein the longer and wider surfaces of the distal portion relative to the proximal portion enable creation of backspin on the golf ball while launching the golf ball, the distal portion terminating at a distal concave point, the proximal portion terminating at a proximal concave point, the proximal portion and the proximal concave point defining a wedge shape, wherein the generally concave configuration of the distal concave point and proximal concave point enable enhanced gripping of the plurality of dimples of the golf ball, the pair of lateral retention arms disposed laterally relative to the nest, the pair of lateral retention arms extending outwardly from the nest in opposite directions to each other and form an arc away from the nest and conform to a contour of the golf ball, wherein the arc is sized and dimensioned to retain the golf ball on the nest, the base having an opening, the base configured to be fixed in relation to the nest;

a ball plunger, the ball plunger disposed concentrically in the nest for helping to retain the golf ball; and a shaft, the shaft defined a head end and a handle end, the head end configured to detachably mate with the opening of the base.

13. The device of claim 12, wherein the distance between the distal portion and the proximal portion of the C-shaped head is about 1.69 inches.

14. The device of claim 12, wherein the material composition of the C-shaped head includes at least one member selected from the group consisting of:

aluminum, metal alloys, wood, fiberglass, bamboo, and a rigid polymer.

15. The device of claim 12, wherein the shaft is generally elongated and flexible.

16. The device of claim 12, wherein the shaft is about 2 feet long.

* * * * *